US010923866B2

(12) United States Patent
Sato

(10) Patent No.: US 10,923,866 B2
(45) Date of Patent: Feb. 16, 2021

(54) CONNECTION TERMINAL AND TERMINAL CONNECTION STRUCTURE

(71) Applicant: YAZAKI CORPORATION, Tokyo (JP)

(72) Inventor: Takahiko Sato, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 38 days.

(21) Appl. No.: 16/434,812

(22) Filed: Jun. 7, 2019

(65) Prior Publication Data

US 2019/0379168 A1 Dec. 12, 2019

(30) Foreign Application Priority Data

Jun. 11, 2018 (JP) ..... 2018-111228

(51) Int. Cl.

| | |
|---|---|
| ***H01R 24/20*** | (2011.01) |
| ***H01R 13/639*** | (2006.01) |
| ***H01R 24/28*** | (2011.01) |
| *H01R 4/18* | (2006.01) |
| *H01R 101/00* | (2006.01) |

(52) U.S. Cl.
CPC ..... *H01R 24/20* (2013.01); *H01R 13/639* (2013.01); *H01R 24/28* (2013.01); *H01R 4/183* (2013.01); *H01R 2101/00* (2013.01)

(58) Field of Classification Search
CPC ..... H01R 24/20; H01R 4/183
USPC ..... 439/877, 851, 290
See application file for complete search history.

(56) References Cited

U.S. PATENT DOCUMENTS 2,785,387 A * 3/1957 Batcheller ..... H01R 13/115 439/290
3,099,510 A * 7/1963 Piorunneck ..... H01R 13/111 439/851
3,381,261 A * 4/1968 Deakin ..... H01R 13/111 439/787
5,108,304 A * 4/1992 Bogiel ..... H01R 13/28 439/287
5,254,022 A * 10/1993 Stuart ..... H01R 4/20 439/851

(Continued)

FOREIGN PATENT DOCUMENTS

| | | |
|---|---|---|
| DE | 10 2011 077 165 A1 | 1/2012 |
| GB | 2 280 791 A | 2/1995 |
| JP | 2002-25674 A | 1/2002 |

*Primary Examiner* — Neil Abrams
(74) *Attorney, Agent, or Firm* — Kenealy Vaidya LLP

(57) ABSTRACT

A connection terminal includes: a tubular electric wire connection portion configured to be tightened and crimped to an end portion of an electric wire; a tubular intermediate portion which includes one end continuously formed at one open end of the electric wire connection portion and which has a cross-sectional shape larger than a cross-sectional shape of the electric wire connection portion; and a tubular terminal connection portion which is continuously formed at another end of the intermediate portion and which has a cross-sectional shape larger than the cross-sectional shape of the intermediate portion. The connection terminal further includes a terminal contact portion which protrudes inwardly from the terminal connection portion. A pair of terminals each formed in this manner and having basically the same shape may be joined to a pair of wires and connected to each other.

5 Claims, 8 Drawing Sheets

(56) References Cited

U.S. PATENT DOCUMENTS

| | | | | |
|---|---|---|---|---|
| 6,893,301 | B2 * | 5/2005 | Kuwayama | H01R 4/188 439/877 |
| 7,033,194 | B1 * | 4/2006 | Le Beau | H01R 13/11 439/290 |
| 7,909,667 | B1 * | 3/2011 | Rossman | H01R 4/203 439/877 |
| 8,342,893 | B2 * | 1/2013 | Glick | H01R 13/187 439/840 |
| 8,851,939 | B2 * | 10/2014 | Bazenas | H01R 13/523 439/840 |
| 10,193,261 | B2 * | 1/2019 | Pittenger | H01R 13/05 |
| 2012/0000329 | A1 | 1/2012 | Glick et al. | |
| 2012/0003880 | A1 | 1/2012 | Glick et al. | |
| 2012/0003882 | A1 | 1/2012 | Stewart et al. | |
| 2012/0003883 | A1 | 1/2012 | Pavlovic et al. | |
| 2012/0322322 | A1 | 12/2012 | Stewart et al. | |

* cited by examiner

CONNECTION TERMINAL AND TERMINAL CONNECTION STRUCTURE

CROSS-REFERENCES TO RELATED APPLICATIONS

This application is based on and claims priority from Japanese Patent Application No. 2018-111228 filed on Jun. 11, 2018, the entire contents of which are incorporated herein by reference.

FIELD

One or more embodiments of the present invention relate to a connection terminal and a terminal connection structure.

BACKGROUND

JP-A-2002-25674 discloses a male-female common terminal which can be used without distinguishing between a male terminal and a female terminal. According to such a male-female common terminal, a manufacturing cost can be reduced by realizing a single type of connection terminals having a common structure which allows the connection terminals are connected to each other.

The connection terminal disclosed in JP-A-2002-25674 includes an electric wire connection portion on one side and a terminal connection portion on another side. The terminal connection portion includes a tab connection portion having an elongated plate shape, an embossed portion formed in a protruding shape on one lateral surface side of the tab connection portion, and tab hold pieces that extend from side edge portions of the tab connection portion on the side of the electric wire connection portion and are disposed to oppose each other with a predetermined interval on the one lateral surface of the tab connection portion.

When the connection terminals is used for connection between electric wires, crimp pieces of the electric wire connection portions are crimped and connected to electric wire end portions, respectively, and the terminal connection portions of the connection terminals attached to the electric wires are connected to each other.

SUMMARY

When the terminal connection portions of the connection terminals described above are connected, the tab connection portion in each connection terminal is inserted between the two hold pieces and the embossed portion while one of the connection terminals is in an inverted orientation. Therefore, the electric wires whose electric wire end portions are respectively crimped to the crimp piece of each of the electric wire connection portions are disposed such that axial centers of the electric wires are mutually shifted in parallel. Therefore, the connection terminals connected with each other have a large body size, which may make it difficult to install the connection terminals in a narrow space.

One or more embodiments of the present invention have been made in view of the above circumstances, and an object thereof is to provide a connection terminal and a terminal connection structure capable of making an installation space compact by reducing a body size when the connection terminals are connected with each other while reducing a manufacturing cost by realizing a single type of the connection terminals.

The object of one or more embodiments of the present invention described above is achieved by the connection terminal and the terminal connection structure of following items.

(1) A connection terminal includes a tubular electric wire connection portion which is configured to be tightened and crimped to an end portion of an electric wires, a tubular intermediate portion which includes one end continuously formed at one open end of the electric wire connection portion and which has a cross-sectional shape larger than a cross-sectional shape of the electric wire connection portion, a tubular terminal connection portion which is continuously formed at another end of the intermediate portion and which has a cross-sectional shape larger than the cross-sectional shape of the intermediate portion, and a terminal contact portion which protrudes inwardly from the terminal connection portion.

According to the connection terminal of the configuration according to the item (1), the electric wire connection portion side of the one connection terminal is inserted so as to overlap inward from the terminal connection portion side of the other connection terminal. The intermediate portion of the one connection terminal is brought into contact with the terminal contact portion of the other connection terminal so that the one connection terminal and the other connection terminal having the same shape can be electrically connected. Therefore, a manufacturing cost of the connection terminals can be reduced by realizing a single type of the connection terminals as male-female common terminals. The intermediate portion of the other connection terminal is inserted into the terminal connection portion of the one connection terminal so that body sizes of the connection terminals connected with each other can also be reduced in the terminal fitting direction.

(2) The connection terminal according to the item (1), wherein the terminal contact portion includes a plastically deformed part configured by a portion of the terminal connection portion which is sandwiched between a pair of parallel slits having a predetermined length along a terminal fitting direction of the terminal connection portion so as to protrude toward an inside of the terminal connection portion.

According to the connection terminal of the configuration according to the item (2), the portion sandwiched between the pair of parallel slits formed in the terminal connection portion has a doubly-supported beam shape so that a large elastic contact force can be applied by small plastic deformation. Therefore, a stable contact resistance can be attained even when the one connection terminal and the other connection terminal electrically connected with each other are slightly inclined to each other. In addition, the portion sandwiched between the pair of parallel slits formed along the terminal fitting direction of the terminal connection portion can elastically contact the intermediate portion of the inserted connection terminal with a surface, and the interconnection can be smoothly performed.

(3) A terminal connection structure includes a first electric wire connection portion which is tightened and crimped to an end portion of a first electric wire inserted from an electric wire connection portion side of a first connection terminal having a same configuration as that of the connection terminal according to the item (1) or (2), and a second electric wire connection portion which is tightened and crimped to an end portion of a second electric wire inserted from a terminal connection portion side of a second connection terminal having a same configuration as that of the connection terminal according to the item (1) or (2). An intermediate portion of the second connection terminal is inserted into a terminal connection portion of the first connection terminal and is brought into contact with the terminal contact portion of the first connection terminal such that the first connection terminal and the second connection terminal having a same shape are electrically connected.

According to the terminal connection structure of the configuration according to the item (3), the end portion of the other electric wire can be inserted into the electric wire connection portion from the terminal connection portion side of the second connection terminal and can be tightened and crimped while the end portion of the one electric wire is inserted into the electric wire connection portion from the electric wire connection portion side of the first connection terminal and is tightened and crimped. Therefore, the electric wire connection portion side of the second connection terminal is inserted so as to overlap inward from the terminal connection portion side of the first connection terminal. The intermediate portion of the second connection terminal is brought into contact with the terminal contact portion of the first connection terminal so that the first connection terminal and the second connection terminal having the same shape are electrically connected.

Therefore, the electric wires in which the electric wire end portion is crimped to each of the electric wire connection portions formed in a tubular shape concentric with the tubular terminal connection portion so that the connection terminals connected with each other are prevented from increasing in body size in a direction orthogonal to the terminal fitting direction. The intermediate portion of the second connection terminal is inserted into the terminal connection portion of the first connection terminal so that body sizes of the connection terminals connected with each other can also be reduced in the terminal fitting direction.

(4) The terminal connection structure according to the item (3) further includes a housing including a reception portion configured to receive the first connection terminal and the second connection terminal connected with each other to maintain a connection state of the first connection terminal and the second connection terminal.

According to the terminal connection structure of the configuration according to the item (4), the first connection terminal and the second connection terminal connected with each other are received by the reception portion of the housing to maintain the connection state. Therefore, a stable connection state of the first connection terminal and the second connection terminal can be attained.

According to the aspects of the present invention, it is possible to provide a connection terminal and a terminal connection structure that are capable of making an installation space compact by reducing body sizes when the connection terminals are connected with each other while reducing a manufacturing cost by realizing a single type of the connection terminals.

The aspects of the present invention are briefly described as above. Details of the aspects of the prevent invention are further clarified by reading a mode (hereinafter, referred to as "embodiment") for carrying out the invention described below with reference to the accompanying drawings.

BRIEF DESCRIPTION OF DRAWINGS

FIGS. 4A and 4B are perspective views illustrating a terminal connection structure according to the first embodiment of the present invention, in which FIG. 4A illustrates a state before a first connection terminal and a second connection terminal are connected, and FIG. 4B illustrates a state where the first connection terminal and the second connection terminal are connected.

FIGS. 6A and 6B are explanatory views illustrating a terminal connection structure according to a second embodiment of the present invention, in which FIG. 6A is a perspective view illustrating a state before a first connection terminal and a second connection terminal are connected, and FIG. 6B is a cross-sectional perspective view illustrating a state where the first connection terminal and the second connection terminal are connected.

FIGS. 7A and 7B are explanatory views illustrating a terminal connection structure according to a third embodiment of the present invention, in which FIG. 7A is a perspective view illustrating a state before a first connection terminal and a second connection terminal are connected, and FIG. 7B is a cross-sectional perspective view illustrating a state where the first connection terminal and the second connection terminal are connected.

DETAILED DESCRIPTION

Hereinafter, embodiments according to the present invention are described with reference to the drawings.

Figure 1A:
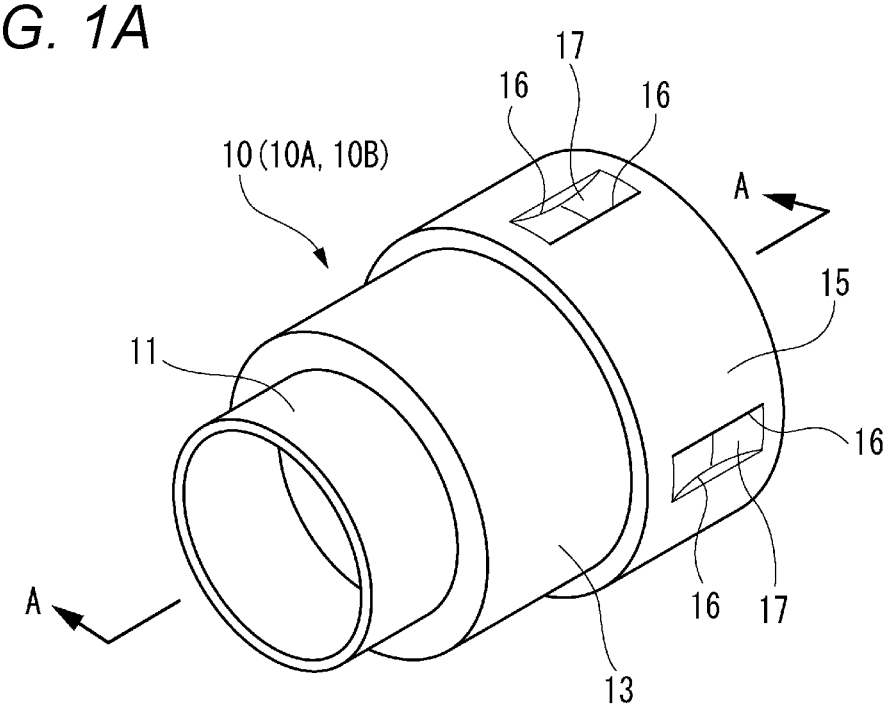
FIG. 1A is a perspective view of a connection terminal according to a first embodiment of the present invention.
Figure 1B:
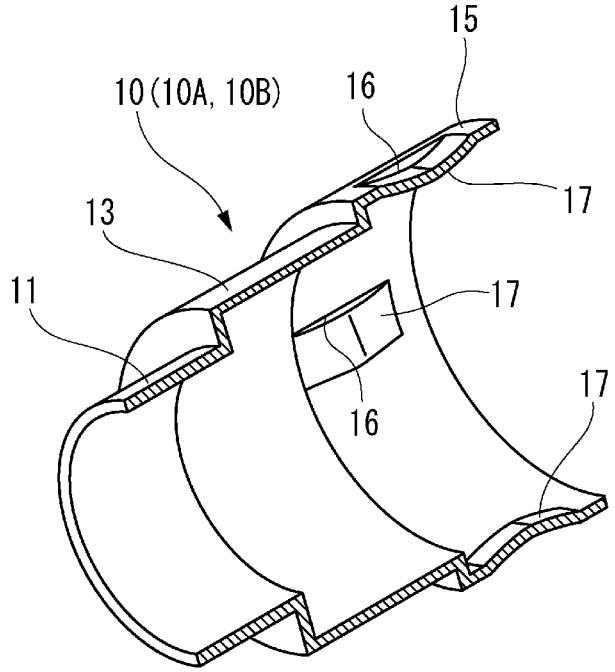
FIG. 1B is a cross section taken along a line A-A in FIG. 1A.

As illustrated in FIGS. 1A and 1B, a connection terminal 10 according to a first embodiment of the present invention is a male-female common terminal made of copper alloy or the like.

The connection terminal 10 according to the first embodiment mainly includes a cylindrical electric wire connection portion 11, a cylindrical intermediate portion 13 of which one end is continuously formed at one opening end of the electric wire connection portion 11, a cylindrical terminal connection portion 15 formed continuously at another end of the intermediate portion 13, and a terminal contact portion 17 formed in a protruding shape inside the terminal connection portion 15.

The electric wire connection portion 11 is tightened and crimped to an end portion of a conductor 21 of each of electric wires 20A (20B) described later. The intermediate portion 13 has a circular cross-sectional shape larger than a circular cross-sectional shape of the electric wire connection portion 11. That is, the intermediate portion 13 is continuously formed with a level difference such that a cylindrical inner diameter of the intermediate portion 13 is larger than a cylindrical outer diameter of the electric wire connection portion 11. The terminal connection portion 15 has a circular cross-sectional shape larger than the circular cross-sectional shape of the intermediate portion 13. That is, the terminal connection portion 15 is continuously formed with a level difference such that a cylindrical inner diameter of the terminal connection portion 15 is larger than a cylindrical outer diameter of the intermediate portion 13.

The terminal contact portion 17 is formed by plastically deforming a portion, which is sandwiched between a pair of parallel slits 16 formed with a predetermined length along a terminal fitting direction of the terminal connection portion 15 and which has a doubly-supported beam shape, so as to protrude toward an inside of the terminal connection portion 15. The terminal contact portion 17 is not limited to the doubly-supported beam shape configuration according to the present embodiment. The terminal contact portion 17 may have a cantilever shape or may be a convex portion or the like formed by bead processing on the terminal connection portion 15 as long as the terminal contact portion 17 can contact the intermediate portion 13 of another connection terminal 10.

Four terminal contact portions 17 according to the first embodiment are formed at equal intervals along a circumferential direction of the terminal connection portion 15. However, a number of the terminal contact portion 17 is not limited to four and may be one or more. A favorable contact state can be attained by forming a plurality of terminal contact portions 17 at equal intervals along the circumferential direction of the terminal connection portion 15.

The connection terminals 10 having the above configuration can form a terminal connection structure according to the first embodiment that is configured to electrically connect the electric wires 20A, 20B with each other by using a first connection terminal 10A and a second connection terminal 10B that have the same shape and the same dimension.

Each of the electric wires 20A, 20B is, for example, a coated electric wire in which a periphery of a conductor 21 is coated with an insulator 23. The conductor 21 is formed by twisting together strands of a conductive metal material mainly made of copper. The conductor 21 is extrusion-coated with the insulator 23.

Figure 2A:
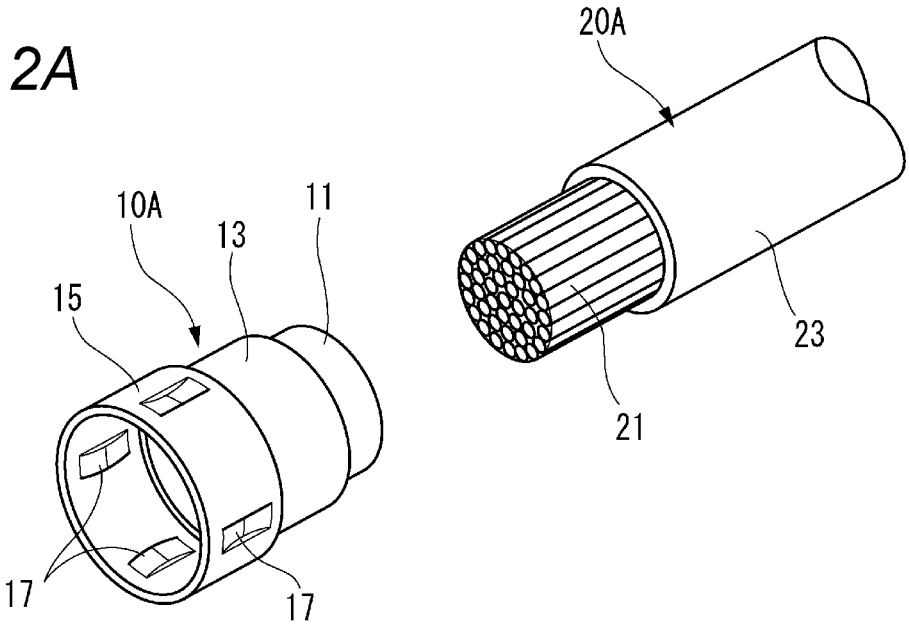
FIGS. 2A to 2C are perspective views illustrating a procedure of tightening and crimping an end portion of one of electric wires inserted from an electric wire connection portion side in the connection terminal illustrated in FIGS. 1A and 1B to the electric wire connection portion.
Figure 2B:
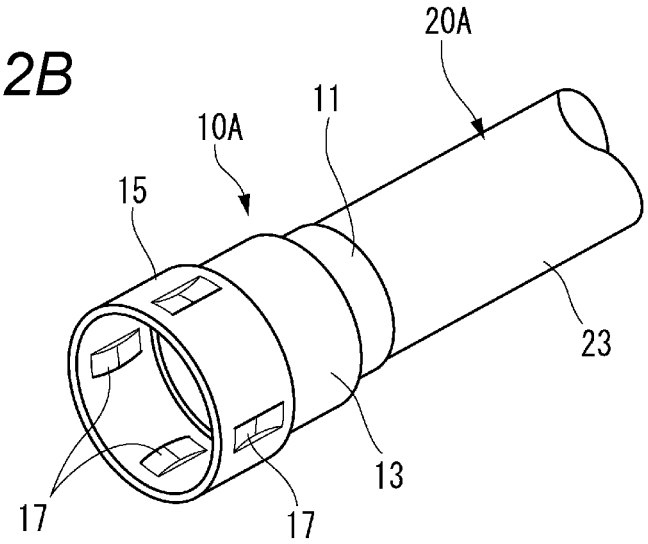
Figure 2C:
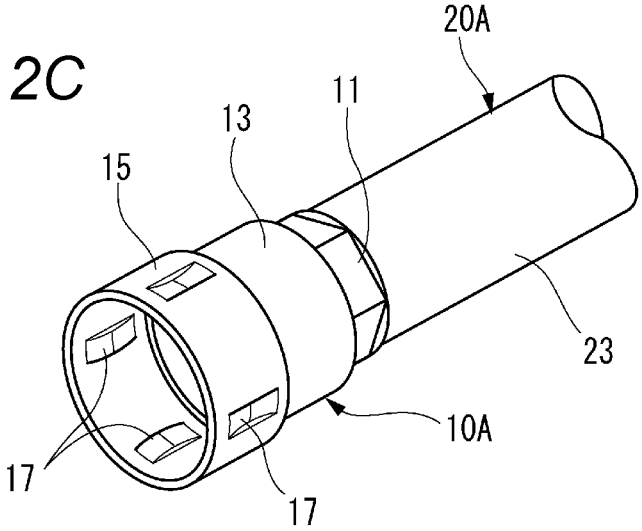
Figure 3A:
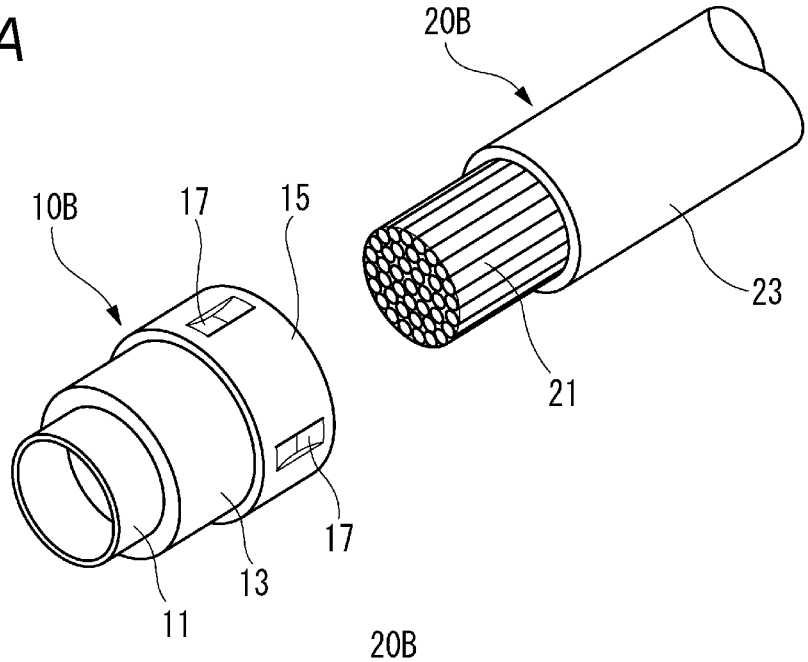
FIGS. 3A to 3C are perspective views illustrating a procedure of tightening and crimping an end portion of another electric wire inserted from a terminal connection portion side in the connection terminal illustrated in FIGS. 1A and 1B to the electric wire connection portion.
Figure 3B:
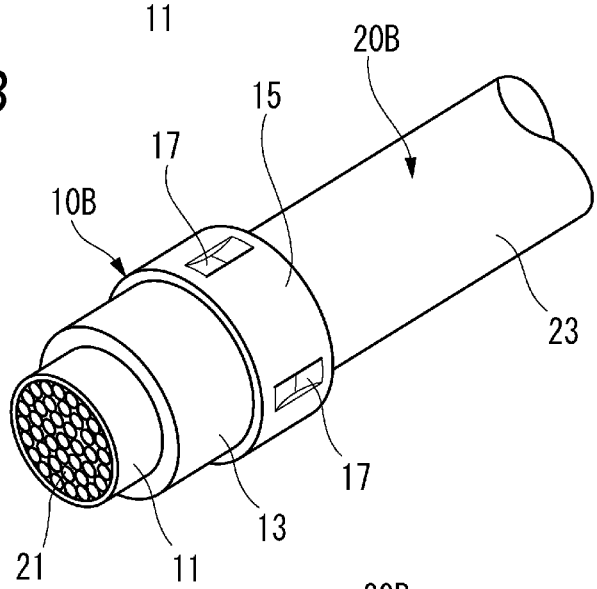
Figure 3C:
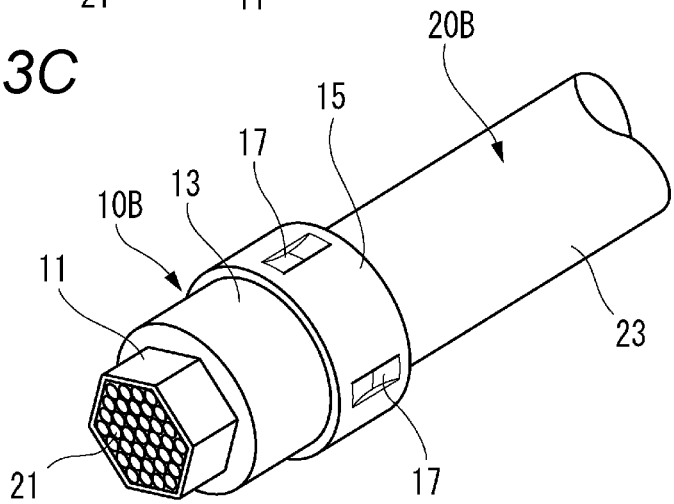

FIGS. 2A to 2C are perspective views illustrating a procedure of tightening and crimping an end portion of one electric wire 20A inserted from an electric wire connection portion 11 side in the connection terminal 10 illustrated in FIGS. 1A and 1B to the electric wire connection portion 11. FIGS. 3A to 3C are perspective views illustrating a procedure of tightening and crimping an end portion of the other electric wire 20B inserted from a terminal connection portion 15 side in the connection terminal 10 illustrated in FIGS. 1A and 1B to the electric wire connection portion 11.

In the following description, the connection terminal 10 crimped to the end portion of the one electric wire 20A is referred to as the first connection terminal 10A, and the connection terminal 10 crimped to the end portion of the other electric wire 20B is referred to as the second connection terminal 10B.

First, as illustrated in FIG. 2A, the insulator 23 at the end portion of the electric wire is removed to expose the conductor 21 at the end portion of the one electric wire 20A.

Next, as illustrated in FIG. 2B, the end portion of the one electric wire 20A is inserted from the electric wire connection portion 11 side of the first connection terminal 10A, and the conductor 21 is disposed in the electric wire connection portion 11.

Then, as illustrated in FIG. 2C, the electric wire connection portion 11 of the first connection terminal 10A is tightened and crimped to the conductor 21 by a crimp die (not illustrated) that is configured to form the electric wire connection portion 11, which is a tightened portion of the first connection terminal 10A, to a hexagonal cross section. Therefore, the first connection terminal 10A having the terminal connection portion 15 opened is crimped and fixed to the end portion of the one electric wire 20A.

Similarly, as illustrated in FIG. 3A, the insulator 23 at the end portion of the electric wire is removed to expose the conductor 21 at the end portion of the other electric wire 20B.

Next, as illustrated in FIG. 3B, the end portion of the other electric wire 20B is inserted from the terminal connection portion 15 side of the second connection terminal 10B, and the conductor 21 is disposed in the electric wire connection portion 11 through the intermediate portion 13.

Then, as illustrated in FIG. 3C, the electric wire connection portion 11 of the second connection terminal 10B is tightened and crimped to the conductor 21 by a crimp die (not illustrated) that is configured to form the electric wire connection portion 11, which is a tightened portion of the second connection terminal 10B, to a hexagonal cross section. Therefore, the second connection terminal 10B having the electric wire connection portion 11 disposed at a tip end portion is crimped and fixed to the end portion of the other electric wire 20B.

Figure 4A:
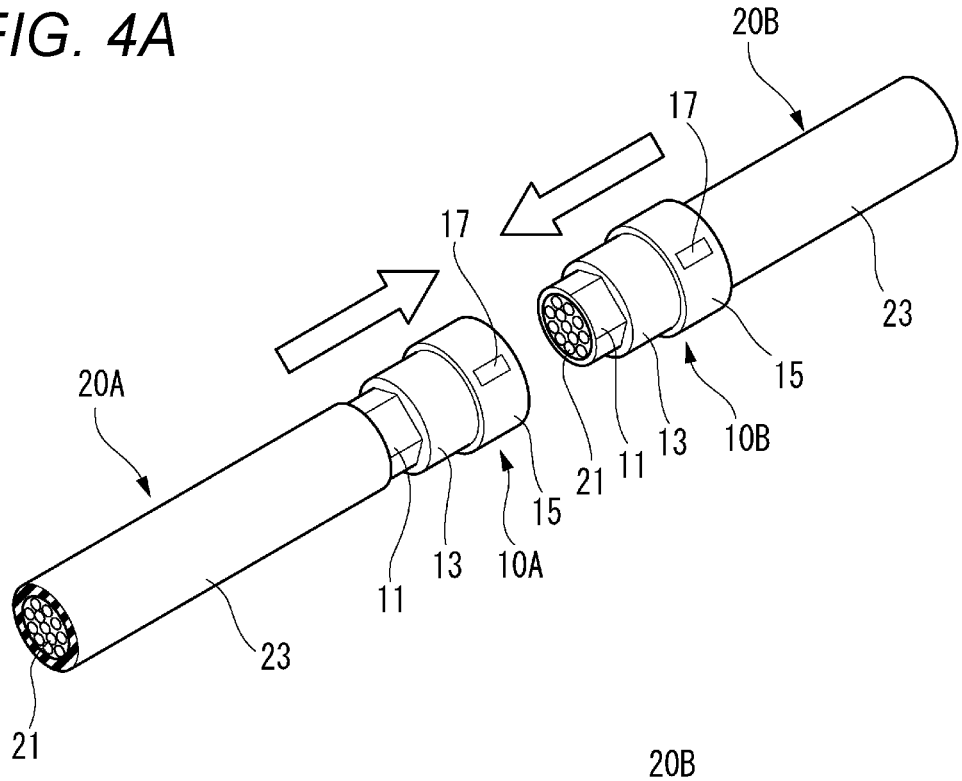
Figure 4B:
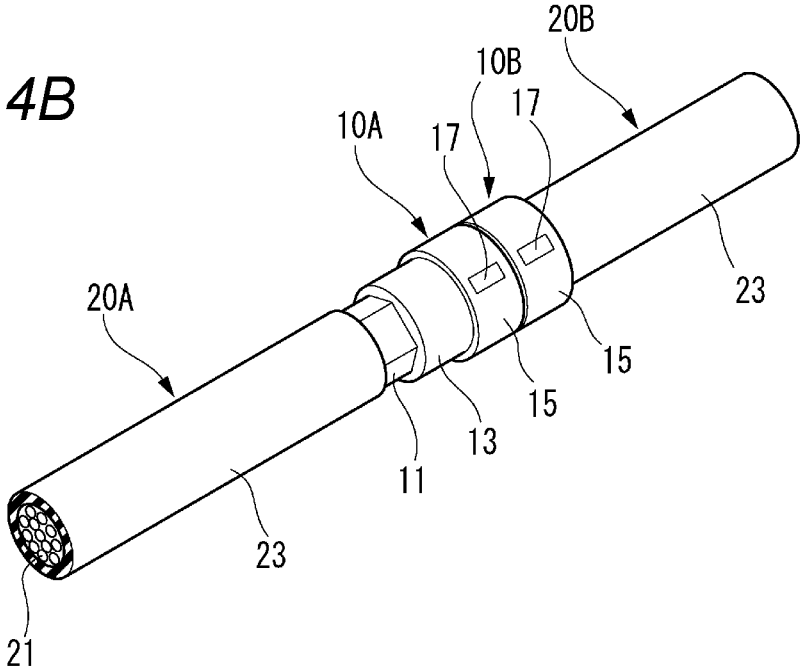

FIGS. 4A and 4B are perspective views illustrating a terminal connection structure according to the first embodiment. FIG. 4A illustrates a state before the first connection terminal 10A and the second connection terminal 10B are connected. FIG. 4B illustrates a state where the first connection terminal 10A and the second connection terminal 10B are connected.

In the terminal connection structure according to the first embodiment, when the first connection terminal 10A and the second connection terminal 10B are connected, the end portion of the one electric wire 20A and the end portion of the other electric wire 20B face each other as illustrated in FIG. 4A. The electric wire connection portion 11 side of the second connection terminal 10B is inserted so as to overlap inward from the terminal connection portion 15 side of the first connection terminal 10A as illustrated in FIG. 4B.

Figure 5A:
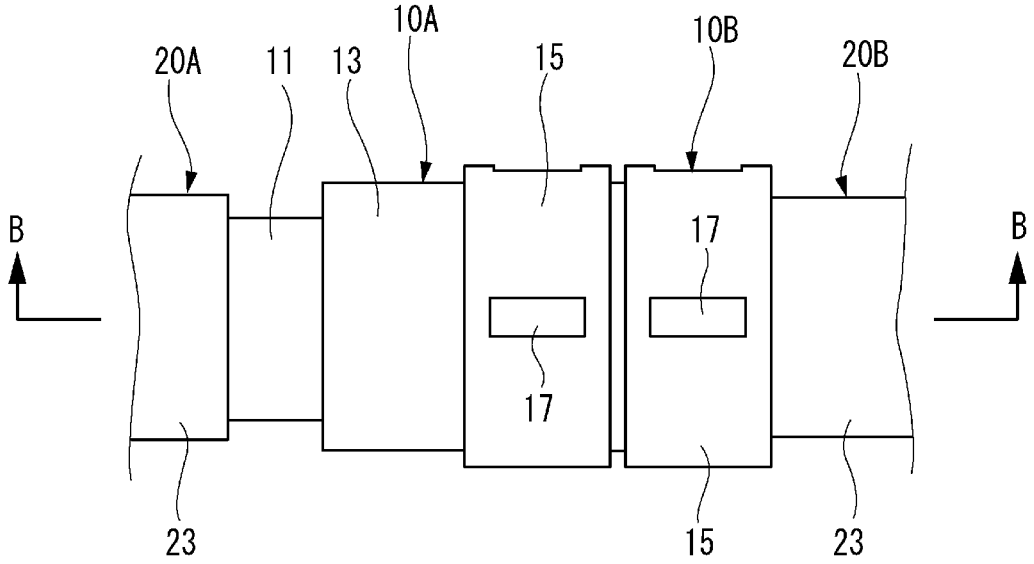
FIG. 5A is an enlarged top view of a main part that illustrates the connection state between the first connection terminal and the second connection terminal illustrated in FIG. 4B.
Figure 5B:
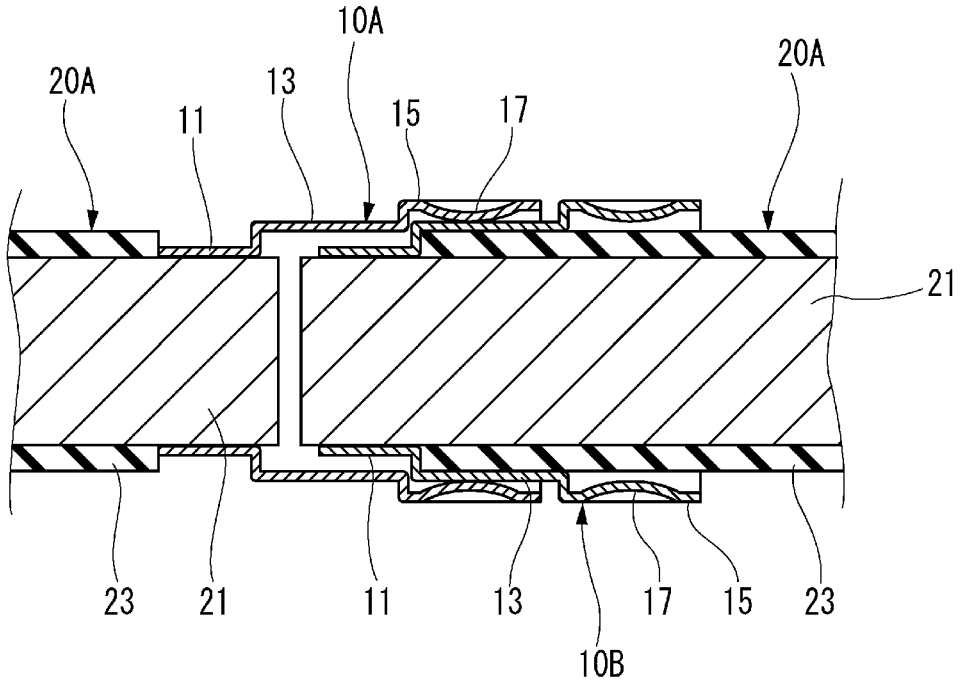
FIG. 5B is a cross-sectional view taken along a line B-B in FIG. 5A.

FIG. 5A is an enlarged top views of a main part that illustrates the connection state between the first connection terminal 10A and the second connection terminal 10B illustrated in FIG. 4B. FIG. 5B is a cross-sectional view taken along a line B-B in FIG. 5A.

As illustrated in FIGS. 5A and 5B, when the second connection terminal 10B is inserted so as to overlap inward of the first connection terminal 10A, the intermediate portion 13 of the second connection terminal 10B is brought into contact with the terminal contact portion 17 of the first connection terminal 10A so that the first connection terminal 10A and the second connection terminal 10B having the same shape are electrically connected.

According to the connection terminal 10 (10A, 10B) according to the first embodiment described above, the electric wire connection portion 11 side of the second connection terminal 10B, which is one of the connection terminals, is inserted so as to overlap inward from the terminal connection portion 15 side of the first connection terminal 10A which is the other connection terminal. The intermediate portion 13 of the second connection terminal 10B is brought into contact with the terminal contact portion 17 of the first connection terminal 10A so that the first connection terminal 10A and the second connection terminal 10B having the same shape can be electrically connected. Therefore, a manufacturing cost of the connection terminals 10 (10A, 10B) can be reduced by realizing a single type of the connection terminals 10 (10A, 10B) as male-female common terminals. The intermediate portion 13 of the second connection terminal 10B is inserted into the terminal connection portion 15 of the first connection terminal 10A so that body sizes of the first connection terminal 10A and the second connection terminal 10B connected with each other can also be reduced in the terminal fitting direction (left-right direction in FIGS. 5A and 5B).

Further, in the connection terminals 10 (10A, 10B) according to the first embodiment, the terminal contact portion 17 is formed by plastically deforming the portion, which is sandwiched between the pair of parallel slits 16 formed with a predetermined length along the terminal fitting direction of the terminal connection portion 15, so as to protrude toward the inside of the terminal connection portion 15.

Therefore, the portion sandwiched between the pair of parallel slits 16 formed in the terminal connection portion 15 as the terminal contact portion 17 has a doubly-supported beam shape so that a large elastic contact force can be applied by small plastic deformation. Therefore, a stable contact resistance can be attained even when the first connection terminal 10A and the second connection terminal 10B electrically connected with each other are slightly inclined to each other. In addition, the portion sandwiched between the pair of parallel slits 16 formed along the terminal fitting direction of the terminal connection portion 15 of the first connection terminal 10A can elastically contact the intermediate portion 13 of the inserted second connection terminal 10B with a surface, and the interconnection can be smoothly performed.

Further, according to the terminal connection structure according to the first embodiment, the conductor 21 of the electric wire end portion of the other electric wire 20B can be inserted into the electric wire connection portion 11 from the terminal connection portion 15 side of the second connection terminal 10B and can be tightened and crimped while the conductor 21 of the electric wire end portion of the one electric wire 20A is inserted into the electric wire connection portion 11 from the electric wire connection portion 11 side of the first connection terminal 10A and is tightened and crimped. Therefore, the electric wire connection portion 11 side of the second connection terminal 10B is inserted so as to overlap inward from the terminal connection portion 15 side of the first connection terminal 10A. The intermediate portion 13 of the second connection terminal 10B is brought into contact with the terminal contact portion 17 of the first connection terminal 10A so that the first connection terminal 10A and the second connection terminal 10B having the same shape are electrically connected.

Therefore, the one electric wire 20A and the other electric wire 20B in which the conductor 21 of the electric wire end portion is crimped to each of the electric wire connection portions 11 formed in a cylindrical shape concentric with the cylindrical terminal connection portion 15 so that the first connection terminal 10A and second connection terminal 10B connected with each other are prevented from increasing in body size in a direction orthogonal to the terminal fitting direction. The intermediate portion 13 of the second connection terminal 10B is inserted into the terminal connection portion 15 of the first connection terminal 10A so that body sizes of the first connection terminal 10A and the second connection terminal 10B connected with each other can also be reduced in the terminal fitting direction.

Therefore, according to the connection terminals 10 (10A, 10B) and the terminal connection structure according to the first embodiment, it is possible to make an installation space compact by reducing body sizes when the connection terminals 10 (10A, 10B) are connected with each other while reducing a manufacturing cost by realizing a single type of the connection terminals 10.

The invention is not limited to the embodiment described above, and may be appropriately modified, improved, and the like. In addition, a material, a shape, a size, a number, an arrangement position, and the like of each constituent element in the embodiment described above are optional as long as the present invention can be achieved, and the present invention is not limited thereto.

Figure 6A:
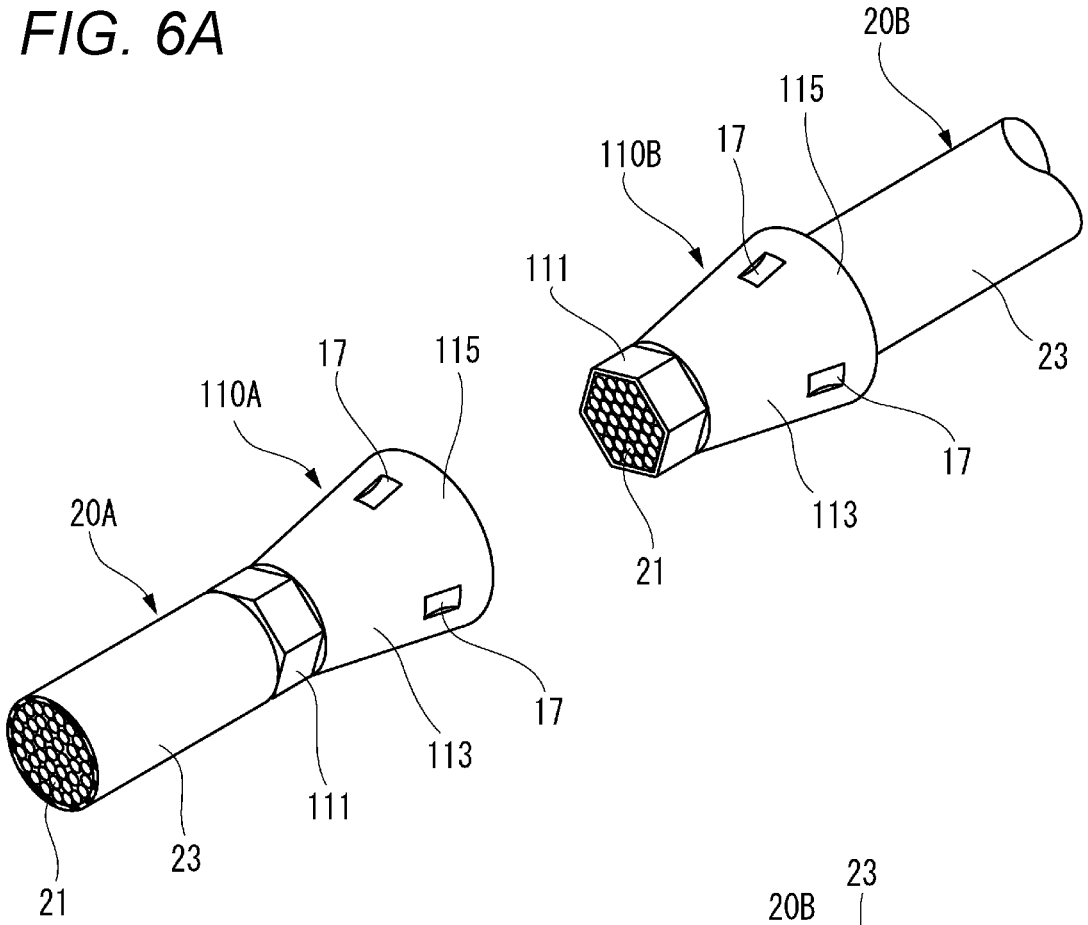
Figure 6B:
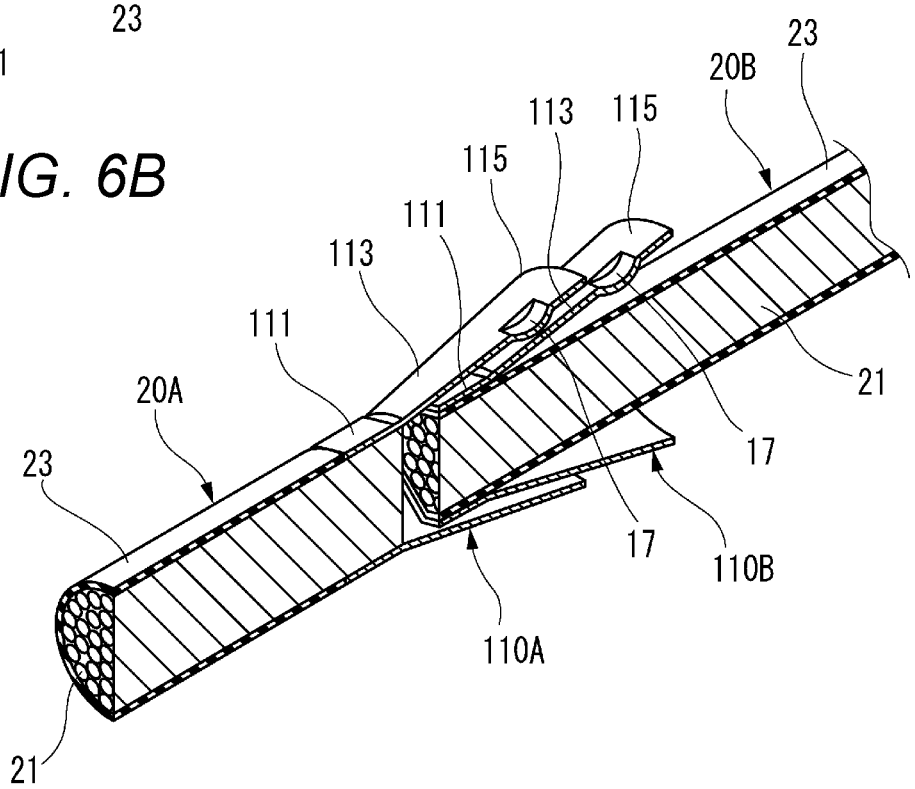

FIGS. 6A and 6B are explanatory views illustrating a terminal connection structure according to a second embodiment of the present invention. FIG. 6A is a perspective view illustrating a state before a first connection terminal 110A and a second connection terminal 110B are connected. FIG. 6B is a cross-sectional perspective view illustrating a state where the first connection terminal 110A and the second connection terminal 110B are connected. Components same as those of the terminal connection structure according to the first embodiment are denoted by the same reference numerals so that a detailed description thereof is omitted.

As illustrated in FIG. 6A, the connection terminals 110A, 110B according to the second embodiment of the present invention mainly include a tubular electric wire connection portion 111, a tubular intermediate portion 113 and a terminal connection portion 115 having a conical surface of which one end is continuously formed at one open end of the electric wire connection portion 111, and the terminal contact portion 17 formed in a protruding shape inside the terminal connection portion 115.

The electric wire connection portion 111 is tightened and crimped to the end portion of the conductor 21 of each of the electric wires 20A (20B) in a hexagonal cross section. The intermediate portion 113 and the terminal connection portion 115 are integrally formed in a tubular shape having a conical surface having a cross-sectional shape larger than a circular cross-sectional shape of the electric wire connection portion 111. That is, the intermediate portion 113 and the terminal connection portion 115 are continuously formed in a tubular shape having a conical surface whose inner diameter gradually increases than a tubular outer diameter of the electric wire connection portion 111.

It is possible to form a terminal connection structure according to the second embodiment that is configured to electrically connect the electric wires 20A, 20B with each other by using the first connection terminal 110A and the second connection terminal 110B that have the above configuration and have the same shape and the same dimension.

First, as illustrated in FIG. 6A, after the end portion of the one electric wire 20A is inserted from the electric wire connection portion 111 side of the first connection terminal 110A and the conductor 21 is disposed in the electric wire connection portion 111, the electric wire connection portion 111 of the first connection terminal 110A is tightened and crimped to the conductor 21.

Similarly, after the end portion of the other electric wire 20B is inserted from the terminal connection portion 115 side of the second connection terminal 110B and the conductor 21 is disposed in the electric wire connection portion 111, the electric wire connection portion 111 of the second connection terminal 110B is tightened and crimped to the conductor 21.

Further, As illustrated in FIG. 6B, when the second connection terminal 110B is inserted so as to overlap inward of the first connection terminal 110A, the intermediate portion 113 of the second connection terminal 110B is brought into contact with the terminal contact portion 17 of the first connection terminal 110A so that the first connection terminal 110A and the second connection terminal 110B having the same shape are electrically connected.

According to the terminal connection structure according to the second embodiment described above which is similar to the terminal connection structure according to the first embodiment, the conductor 21 of the electric wire end portion of the other electric wire 20B can be inserted into the electric wire connection portion 111 from the terminal connection portion 115 side of the second connection terminal 110B and can be tightened and crimped while the conductor 21 of the electric wire end portion of the one electric wire 20A is inserted into the electric wire connection portion 111 from the electric wire connection portion 111 side of the first connection terminal 110A and is tightened and crimped.

Therefore, the electric wire connection portion 111 side of the second connection terminal 110B is inserted so as to overlap inward from the terminal connection portion 115 side of the first connection terminal 110A. The intermediate portion 113 of the second connection terminal 110B is brought into contact with the terminal contact portion 17 of the first connection terminal 110A so that the first connection terminal 110A and the second connection terminal 110B having the same shape are electrically connected.

Therefore, a manufacturing cost of the connection terminals 110A, 110B can be reduced by realizing a single type of the connection terminals 110A, 110B as male-female common terminals.

The case where the intermediate portion 113 and the terminal connection portion 115 are formed in a tubular shape having a conical surface in the connection terminals 110A, 110B according to the second embodiment is described. However, it is a matter of course that the intermediate portion 113 and the terminal connection portion 115 can be formed in a tubular shape that has a polygonal perpendicular surface having a polygonal cross section with three or more corners.

Figure 7A:
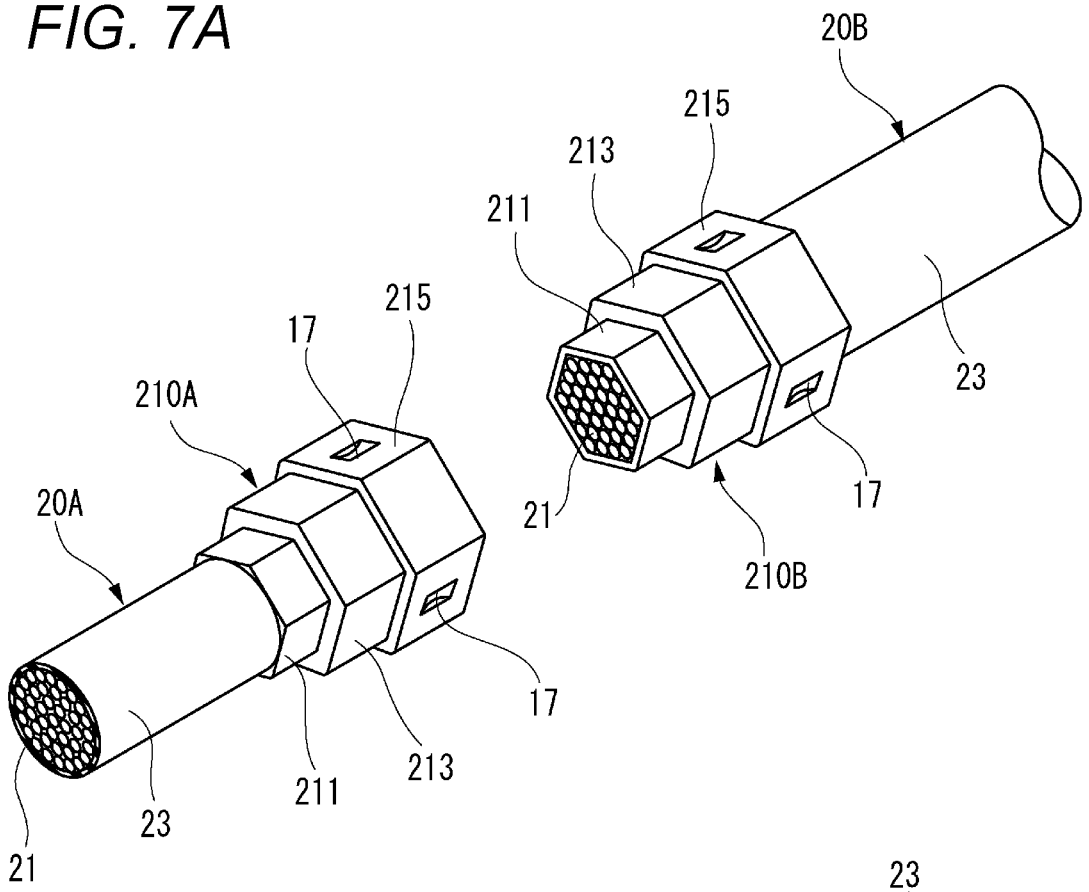
Figure 7B:
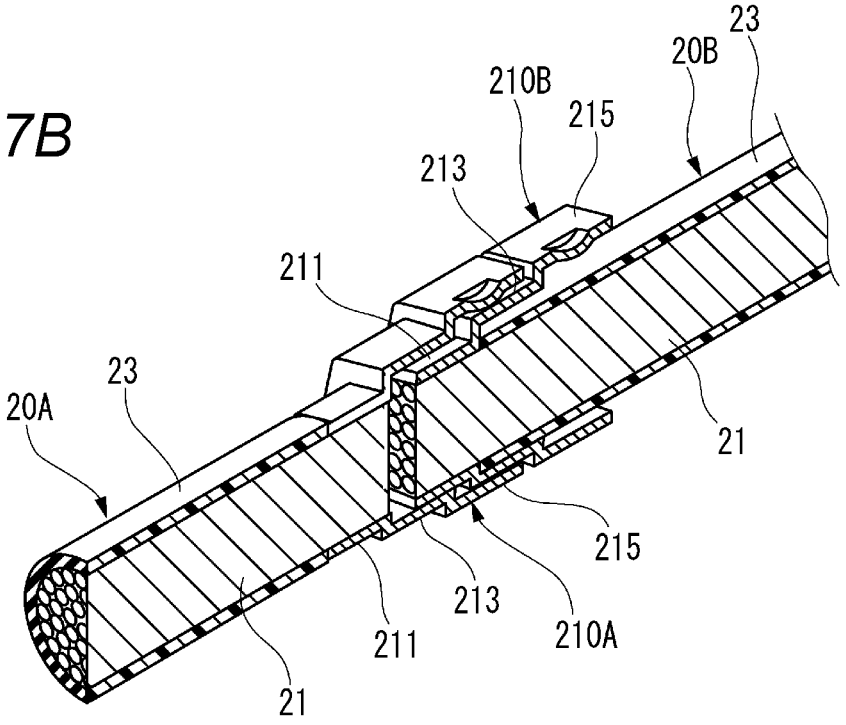

FIGS. 7A and 7B are explanatory views illustrating a terminal connection structure according to a third embodiment of the present invention. FIG. 7A is a perspective view illustrating a state before a first connection terminal 210A and a second connection terminal 210B are connected. FIG. 7B is a cross-sectional perspective view illustrating a state where the first connection terminal 210A and the second connection terminal 210B are connected. Components same as those of the terminal connection structure according to the first embodiment are denoted by the same reference numerals so that a detailed description thereof is omitted.

As illustrated in FIG. 7A, the connection terminals 210A, 210B according to the third embodiment mainly include a cylindrical (or hexagonal tubular) electric wire connection portion 211, a hexagonal tubular intermediate portion 213 of which one end is continuously formed at one open end of the electric wire connection portion 211, a hexagonal tubular terminal connection portion 215 continuously formed at another end of the intermediate portion 213, and the terminal contact portion 17 formed in a protruding shape inside the terminal connection portion 115.

The electric wire connection portion 211 is tightened and crimped to the end portion of the conductor 21 of each of the electric wires 20A (20B) in a hexagonal cross section. The intermediate portion 213 has a hexagonal cross-sectional shape larger than a circular cross-sectional shape of the electric wire connection portion 211. That is, the intermediate portion 213 is continuously formed with a level difference such that a hexagonal tubular inner dimension of the intermediate portion 213 is larger than a tubular outer diameter of the electric wire connection portion 211. The terminal connection portion 215 has a hexagonal cross-sectional shape larger than the hexagonal cross-sectional shape of the intermediate portion 213. That is, the terminal connection portion 215 is continuously formed with a level difference such that a hexagonal tubular inner dimension of the terminal connection portion 215 is larger than a hexagonal tubular outer dimension of the intermediate portion 213.

It is possible to form a terminal connection structure according to the third embodiment that is configured to electrically connect the electric wires 20A, 20B with each other by using the first connection terminal 210A and the second connection terminal 210B that have the above configuration and have the same shape and the same dimension.

First, as illustrated in FIG. 7A, after the end portion of the one electric wire 20A is inserted from the electric wire connection portion 211 side of the first connection terminal 210A and the conductor 21 is disposed in the electric wire connection portion 111, the electric wire connection portion 211 of the first connection terminal 210A is tightened and crimped to the conductor 21.

Similarly, after the end portion of the other electric wire 20B is inserted from the terminal connection portion 215 side of the second connection terminal 210B and the conductor 21 is disposed in the electric wire connection portion 211, the electric wire connection portion 211 of the second connection terminal 210B is tightened and crimped to the conductor 21.

Further, As illustrated in FIG. 7B, when the second connection terminal 210B is inserted so as to overlap inward of the first connection terminal 210A, the intermediate portion 213 of the second connection terminal 210B is brought into contact with the terminal contact portion 17 of the first connection terminal 210A so that the first connection terminal 210A and the second connection terminal 210B having the same shape are electrically connected.

According to the terminal connection structure according to the third embodiment described above which is similar to the terminal connection structure according to the first embodiment, the conductor 21 of the electric wire end portion of the other electric wire 20B can be inserted into the electric wire connection portion 211 from the terminal connection portion 215 side of the second connection terminal 210B and can be tightened and crimped while the conductor 21 of the electric wire end portion of the one electric wire 20A is inserted into the electric wire connection portion 211 from the electric wire connection portion 211 side of the first connection terminal 210A and is tightened and crimped.

Therefore, the electric wire connection portion 211 side of the second connection terminal 210B is inserted so as to overlap inward from the terminal connection portion 215 side of the first connection terminal 210A. The intermediate portion 213 of the second connection terminal 210B is brought into contact with the terminal contact portion 17 of the first connection terminal 210A so that the first connection terminal 210A and the second connection terminal 210B having the same shape are electrically connected.

Therefore, a manufacturing cost of the connection terminals 210A, 210B can be reduced by realizing a single type of the connection terminals 210A, 210B as male-female common terminals.

The case where the intermediate portion 213 and the terminal connection portion 215 are formed in a hexagonal tubular shape in the connection terminals 210A, 210B according to the third embodiment is described. However, it is a matter of course that the intermediate portion 213 and the terminal connection portion 215 can be formed in a polygonal tubular shape having a polygonal cross section with three or more corners.

Figure 8A:
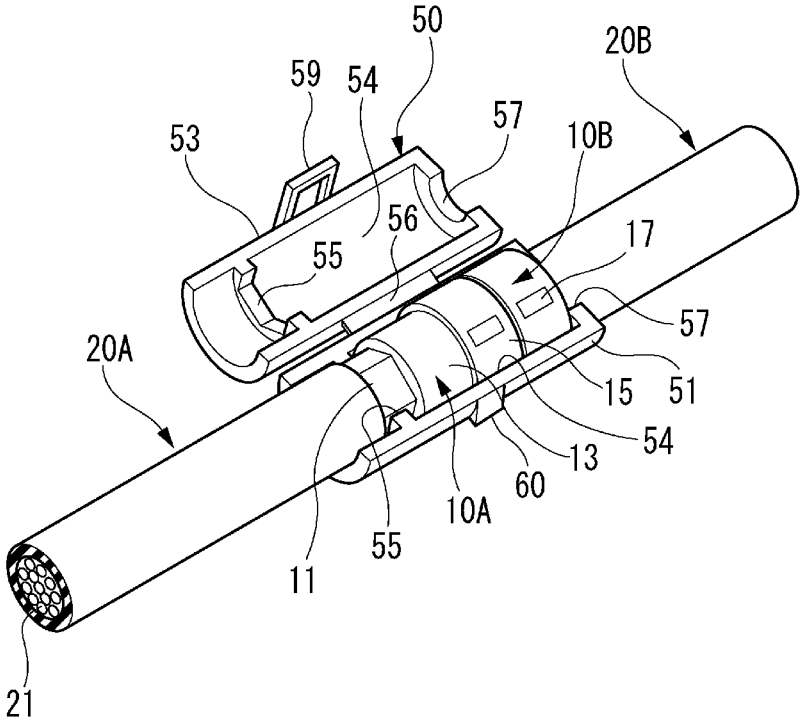
FIGS. 8A and 8B are perspective views illustrating a procedure of receiving a first connection terminal and a second connection terminal in a reception portion of a housing in a terminal connection structure according to a fourth embodiment of the present invention.
Figure 8B:
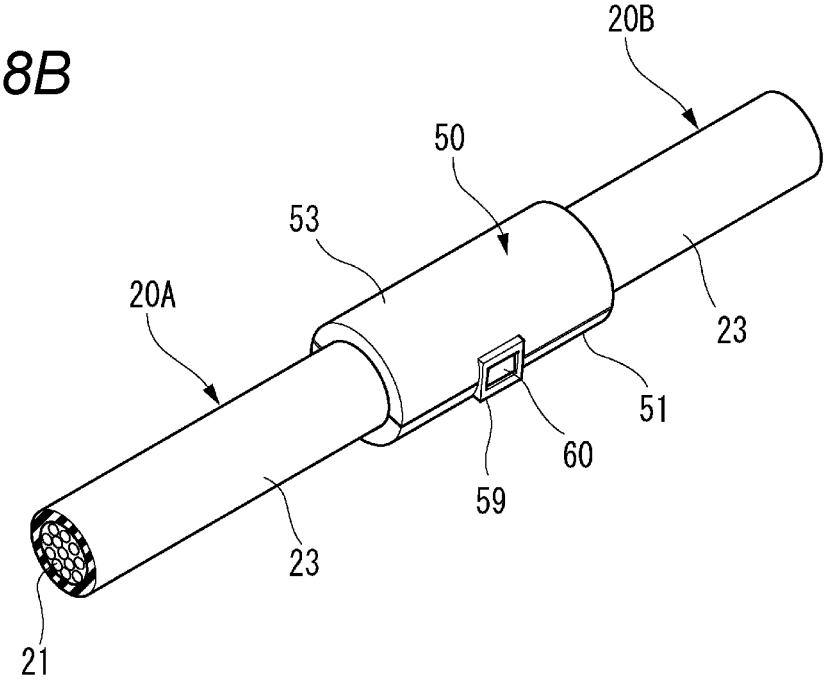

FIGS. 8A and 8B are perspective views illustrating a procedure of receiving the first connection terminal 10A and the second connection terminal 10B in a reception portion 54 of a housing 50 in a terminal connection structure according to a fourth embodiment of the present invention. Components same as those of the terminal connection structure according to the first embodiment are denoted by the same reference numerals so that a detailed description thereof is omitted.

The terminal connection structure according to the fourth embodiment includes the housing 50 including the reception portion 54 that is configured to receive the first connection terminal 10A and the second connection terminal 10B connected with each other and to maintain the connection state.

As illustrated in FIG. 8A, in the housing 50, a lower half body 51 and an upper half body 53 each including the reception portion 54 that is configured to receive the first connection terminal 10A and the second connection terminal 10B connected with each other and to maintain the connection state are formed integrally and rotatably by a thin hinge 56.

A lock protrusion 60 is provided at a side edge of the lower half body 51 opposite to the thin hinge 56. A lock arm 59 that is configured to lock the lock protrusion 60 is provided at a side edge of the upper half body 53 opposite to the thin hinge 56.

A first fitting portion 55, which is fitted to an outer peripheral surface of the electric wire connection portion 11 of the first connection terminal 10A connected with the second connection terminal 10B, is provided on one end side (left end side in FIGS. 8A and 8B) of the reception portion 54 of each of the lower half body 51 and the upper half body 53. The first fitting portion 55 is engaged with a step portion between the electric wire connection portion 11 and the intermediate portion 13 of the first connection terminal 10A, which prevents the first connection terminal 10A from slipping out from the one end side of the reception portion 54.

A second fitting portion 57, which is fitted to an outer peripheral surface of the other electric wire 20B that is connected to the electric wire connection portion 11 of the second connection terminal 10B connected with the first connection terminal 10A, is provided on another end side (right end side in FIGS. 8A and 8B) of the reception portion 54 of each of the lower half body 51 and the upper half body 53. The second fitting portion 57 is engaged with an open end of the terminal connection portion 15 of the second connection terminal 10B, which prevents the second connection terminal 10B from slipping out from the other end side of the reception portion 54.

Therefore, as illustrated in FIG. 8A, the first connection terminal 10A and the second connection terminal 10B connected with each other are placed in the reception portion 54 of the lower half body 51. At this time, the cylindrical first connection terminal 10A and the cylindrical second connection terminal 10B do not need to be restricted in a direction in a rotation direction about a central axis when the first connection terminal 10A and the second connection terminal 10B are placed in the reception portion 54, so that assembly workability is good.

When the upper half body 53 is rotated about the thin hinge 56 to lock the lock arm 59 to the lock protrusion 60, as illustrated in FIG. 8B, the lower half body 51 and the upper half body 53 are locked in a closed state.

Therefore, according to the terminal connection structure according to the fourth embodiment, the first connection terminal 10A and the second connection terminal 10B connected with each other are received by the reception portion 54 of the housing 50 to maintain the connection state. Therefore, a stable connection state of the first connection terminal 10A and the second connection terminal 10B can be attained.

Here, features of the connection terminal and the terminal connection structure according to the embodiments of the present invention are briefly summarized and listed in following [1] to [4].

[1] A connection terminal (10A, 10B; 110A, 110B; 210A, 210B) including:

a tubular electric wire connection portion (11, 111, 211) which is configured to be tightened and crimped to an end portion of an electric wire (20A, 20B);

a tubular intermediate portion (13, 113, 213) which includes one end continuously formed at one open end of the electric wire connection portion and which has a cross-sectional shape larger than a cross-sectional shape of the electric wire connection portion;

a tubular terminal connection portion (15, 115, 215) which is continuously formed at another end of the intermediate portion and which has a cross-sectional shape larger than the cross-sectional shape of the intermediate portion; and a terminal contact portion (17) which protrudes inwardly from the terminal connection portion.

[2] The connection terminal (10A, 10B; 110A, 110B; 210A, 210B) according to [1], wherein the terminal contact portion (17) includes a plastically deformed part configured by a portion of the terminal connection portion which is sandwiched between a pair of parallel slits (16) having a predetermined length along a terminal fitting direction of the terminal connection portion (15, 115, 215) so as to protrude toward an inside of the terminal connection portion.

[3] A terminal connection structure, including:

a first electric wire connection portion (11, 111, 211) which is tightened and crimped to an end portion of a first electric wire (20A) inserted from an electric wire connection portion side of a first connection terminal (10A, 110A, 210A) having a same configuration as that of the connection terminal according to [1] or [2]; and a second electric wire connection portion (11, 111, 211) which is tightened and crimped to an end portion of a second electric wire (20B) inserted from a terminal connection portion side of a second connection terminal (10B, 110B, 210B) having a same configuration as that of the connection terminal according to [1] or [2], wherein an intermediate portion (13, 113, 213) of the second connection terminal is inserted into a terminal connection portion (15, 115, 215) of the first connection terminal and is brought into contact with the terminal contact portion (17) of the first connection terminal such that the first connection terminal and the second connection terminal having a same shape are electrically connected.

[4] The terminal connection structure according to [3], further including:

a housing (50) including a reception portion (54) configured to receive the first connection terminal (10A) and the second connection terminal (10B) connected with each other to maintain a connection state of the first connection terminal (10A) and the second connection terminal (10B).

The invention claimed is:

1. A connection terminal comprising:

a tubular electric wire connection portion which is configured to be tightened and crimped to an end portion of an electric wire;

a tubular intermediate portion which comprises one end continuously formed at one open end of the electric wire connection portion and which has a cross-sectional shape larger than a cross-sectional shape of the electric wire connection portion;

a tubular terminal connection portion which is continuously formed at another end of the intermediate portion and which has a cross-sectional shape larger than the cross-sectional shape of the intermediate portion; and a terminal contact portion which protrudes inwardly from the terminal connection portion, wherein the tubular electric wire connection portion is configured to be crimped on the end portion of the electric wire in a first orientation in which the tubular intermediate portion and the tubular terminal connection portion extend away from the end portion and are spaced away from the end portion and in a second orientation in which the tubular intermediate portion engages the electric wire and the electric wire passes through each of the tubular intermediate portion and the tubular terminal connection portion.

2. The connection terminal according to claim 1, wherein the terminal contact portion comprises a plastically deformed part configured by a portion of the terminal connection portion which is sandwiched between a pair of parallel slits having a predetermined length along a terminal fitting direction of the terminal connection portion so as to protrude toward an inside of the terminal connection portion.

3. The connection terminal according to claim 1, wherein the tubular intermediate portion has substantially a same diameter throughout an entirety of the tubular intermediated portion in an axial direction of the connection terminal.

4. A terminal connection structure, comprising:

a first connection terminal including:

a first electric wire connection portion which is tightened and crimped to an end portion of a first electric wire inserted from an electric wire connection portion side of the first connection terminal;

a tubular first intermediate portion which comprises one end continuously formed at one open end of the first electric wire connection portion and which has a cross-sectional shape larger than a cross-sectional shape of the first electric wire connection portion;

a tubular first terminal connection portion which is continuously formed at another end of the first intermediate portion and which has a cross-sectional shape larger than the cross-sectional shape of the first intermediate portion; and a first terminal contact portion which protrudes inwardly from the first terminal connection portion; and a second connection terminal including:

a second electric wire connection portion which is tightened and crimped to an end portion of a second electric wire inserted from a terminal connection portion side of the second connection terminal;

a tubular second intermediate portion which comprises one end continuously formed at one open end of the second electric wire connection portion and which has a cross-sectional shape larger than a cross-sectional shape of the second electric wire connection portion;

a tubular second terminal connection portion which is continuously formed at another end of the second intermediate portion and which has a cross-sectional shape larger than the cross-sectional shape of the second intermediate portion; and a second terminal contact portion which protrudes inwardly from the second terminal connection portion, wherein the second intermediate portion of the second connection terminal is inserted into the first terminal connection portion of the first connection terminal and is brought into contact with the first terminal contact portion of the first connection terminal such that the first connection terminal and the second connection terminal having a same shape are electrically connected.

5. The terminal connection structure according to claim 4, further comprising:

a housing comprising a reception portion configured to receive the first connection terminal and the second connection terminal connected with each other to maintain a connection state of the first connection terminal and the second connection terminal.

* * * * *